US006204816B1

(12) United States Patent
MacDonald, Jr. et al.

(10) Patent No.: US 6,204,816 B1
(45) Date of Patent: Mar. 20, 2001

(54) RADIO FREQUENCY ANTENNA

(75) Inventors: James D. MacDonald, Jr., Apex; Gerard James Hayes, Wake Forest; John Michael Spall, Raleigh, all of NC (US)

(73) Assignee: Ericsson, Inc., Research Triangle Park, NC (US)

( * ) Notice: Subject to any disclaimer, the term of this patent is extended or adjusted under 35 U.S.C. 154(b) by 0 days.

(21) Appl. No.: 09/045,753

(22) Filed: Mar. 20, 1998

(51) Int. Cl.[7] ..... H01Q 1/24
(52) U.S. Cl. ..... 343/702; 343/862; 343/901
(58) Field of Search ..... 343/702, 900, 343/901, 850, 860, 862; H01Q 1/24

(56) References Cited

U.S. PATENT DOCUMENTS

| | | | | |
|---|---|---|---|---|
| 5,134,421 | * | 7/1992 | Boyd et al. | 343/873 |
| 5,467,096 | * | 11/1995 | Takamoro et al. | 343/702 |
| 5,534,878 | | 7/1996 | Johnson | 343/702 |
| 5,606,327 | * | 2/1997 | Elliott et al. | 343/702 |
| 5,635,943 | * | 6/1997 | Grunwell | 343/702 |
| 5,659,889 | | 8/1997 | Cockson | 455/575 |
| 5,717,408 | * | 2/1998 | Sullivan et al. | 343/702 |
| 5,856,807 | * | 1/1999 | Davis et al. | 343/702 |
| 5,969,682 | * | 10/1999 | Ito et al. | 343/702 |

FOREIGN PATENT DOCUMENTS

| | | | |
|---|---|---|---|
| 195 47 191 | 6/1997 | (DE) | H01Q/1/22 |
| 0343847 | 11/1989 | (EP) | H01Q/1/24 |
| 0516490 | 12/1992 | (EP) | H01Q/1/24 |
| 0613206 | 8/1994 | (EP) | H01Q/1/24 |
| 0718909 | 6/1996 | (EP) | H01Q/1/24 |
| 2213998 | 8/1989 | (GB) | H01Q/1/10 |

* cited by examiner

*Primary Examiner*—Hoanganh Le
*Assistant Examiner*—Hoang Nguyen
(74) *Attorney, Agent, or Firm*—Wood, Phillips, VanSanten, Clark & Mortimer

(57) ABSTRACT

An antenna assembly has a shaft element with first and second ends. The antenna assembly also has a tube-like element disposed about the first end of the shaft element which tube-like element acts as a matching structure for the antenna assembly and strengthens and rigidifies the antenna assembly to resist bending of the shaft element proximate to the first end thereof. The antenna assembly further has a dielectric material disposed between the tube-like element and the shaft element at the first end. Moreover, the antenna assembly may be combined with a housing to form a radio-communication assembly, the housing having a surface with an edge, the tube-like element acting as a matching structure and strengthening and rigidifying the antenna assembly to resist bending of the shaft element at a fulcrum defined by the edge. Furthermore, a method reconfiguring an antenna on a radio-communication assembly is provided.

26 Claims, 3 Drawing Sheets

RADIO FREQUENCY ANTENNA

FIELD OF THE INVENTION

The present invention is directed to an antenna, and, in particular, to an antenna for use with a portable radio-communication device, such as a cellular phone.

BACKGROUND OF THE INVENTION

In its most basic form, a radio-communication network includes a mobile station, such as a cellular phone, and a base station. The mobile station is in radio-communication with the base station. In turn, the base station is connected to and in communication with a public switched telephone network, which is the fixed network installed in most homes.

To communicate with each other, the mobile station and the base station use antennas. The antennas are used to transmit radio frequency (RF) signals between the mobile station and the base station.

The antenna has a radiating element, and may have a matching structure or element. The radiating element is the portion of the antenna which may be used to radiate the RF signal from one of the mobile station and the base station to the other of the mobile station and the base station. At higher radio frequencies, the matching element may be needed to balance the impedance of the radiating element.

The mobile station antenna typically includes a long rod of circular cross-section. The rod may be used as the radiating element, or the rod may be used as a support for the radiating element. A section of wire, which functions as the matching element, is wrapped about the rod with a layer of dielectric material disposed therebetween. Conventionally, both the rod and the wire are coated with a polymer material for mechanical protection.

The mobile station antenna is typically mounted on a mobile station housing so as to extend through an opening in the housing. The antenna is usually mounted so that it is moveable between a fully retracted position, where only a portion of the antenna projects to outside the housing, and a fully extended position, where a significant portion of the antenna projects to outside the housing.

The above mobile station antennas may have several problems, however. For example, the wire used as the matching element may be susceptible to breakage during the wrapping process. Additionally, the rod element may be susceptible to excessive bending with the antenna in the fully extended position relative to the mobile station housing. Moreover, the size of the antenna in the fully retracted position relative to the housing may be so large as to take up considerable amounts of space within the housing. This is particularly significant because the trend in the cellular phone industry has been to design and manufacture mobile stations of decreasing width, length and depth.

SUMMARY OF THE INVENTION

According to an aspect of the present invention, an antenna assembly has a shaft element with first and second ends. The antenna assembly also has a tube-like element disposed about the first end of the shaft element which tube-like element acts as a matching structure for the antenna assembly and strengthens and rigidifies the antenna assembly to resist bending of the shaft element proximate to the first end thereof. The antenna assembly further has a dielectric material disposed between the tube-like element and the shaft element at the first end.

The shaft element may define a rod-like element or a plate-like element.

Moreover, the shaft element may define a first radiating element, and a second radiating element may coupled to the shaft element at the second end.

The shaft element and the tube-like element each may be made of a nickel-titanium alloy. In particular, the shaft element and the tube-like element each may be made of a nickel-titanium alloy where nickel and titanium are present in approximately equal percentages by weight.

The dielectric material may be selected from the group consisting of polytetrafluoroethylene and polyetherimide.

According to another aspect of the present invention, a portable radio-communication assembly has a housing with a surface having an edge. The portable radio-communication assembly also has an antenna assembly with a shaft element having first and second ends, a tube-like element disposed about the first end of the shaft element, and a dielectric material disposed between the tube-like element and the shaft element at the first end. The shaft element has a first retracted state and a second extended state in which the first end is proximate to the edge, the tube-like element abuttable against the edge so as to resist bending of the shaft element proximate to the edge.

Further, the shaft element may define a first radiating element, and a second radiating element may be coupled to the shaft element at the second end, the second radiating element being disposed outside the housing with the shaft element in the first and second states.

Moreover, the antenna assembly may define a quarter-wavelength radiator with the shaft element in the first state, and may define a half-wavelength radiator with the shaft element in the second state.

The shaft element and the tube-like element each may be made of a nickel-titanium alloy. Specifically, the shaft element and the tube-like element each may be made of a nickel-titanium alloy where nickel and titanium are present in approximately equal percentages by weight.

The dielectric material may be selected from the group consisting of polytetrafluoroethylene and polyetherimide.

According to a further aspect of the present invention, a method of reconfiguring an antenna assembly on a radio-communication assembly having a housing with a surface is provided. The method involves the steps of providing an antenna assembly on the housing with a shaft element moveable between first and second positions relative to the surface of the housing, and providing a matching element on the shaft element such that the matching element mechanically reinforces a part of the shaft element. The method also involves the steps of moving the shaft element from the first position to the second position, and abutting the matching element against the surface of the housing as an incident of the shaft element being moved from the first position into the second position so that the matching element resists deformation of the shaft element adjacent the surface of the housing.

Moreover, the surface of the housing may have an edge. If so, the step of abutting the matching element against the surface of the housing may include the step of abutting the matching element against the edge of the surface of the housing as an incident of the shaft element being moved from the first position into the second position so that the matching element resists deformation of the shaft element about a fulcrum defined by the edge of the surface of the housing.

Additionally, the surface of the housing may define an edge-like rim which further defines an opening in the housing. Consequently, the step of moving the shaft element from the first position to the second position may include the step of moving the shaft element through the opening from the first position to the second position, and the step of abutting the matching element against the surface of the housing may include the step of abutting the matching element against the edge-like rim of the surface of the housing as an incident of the shaft element being moved through the opening from the first position into the second position so that the matching element resists deformation of the shaft element about a fulcrum defined by the edge-like rim of the surface of the housing.

Further, the antenna assembly may define a quarter-wavelength radiator with the shaft element in the first position, and, as an incident of the shaft element being moved from the first position into the second position, may define a half-wavelength radiator.

DETAILED DESCRIPTION OF THE PREFERRED EMBODIMENT

Figure 1:
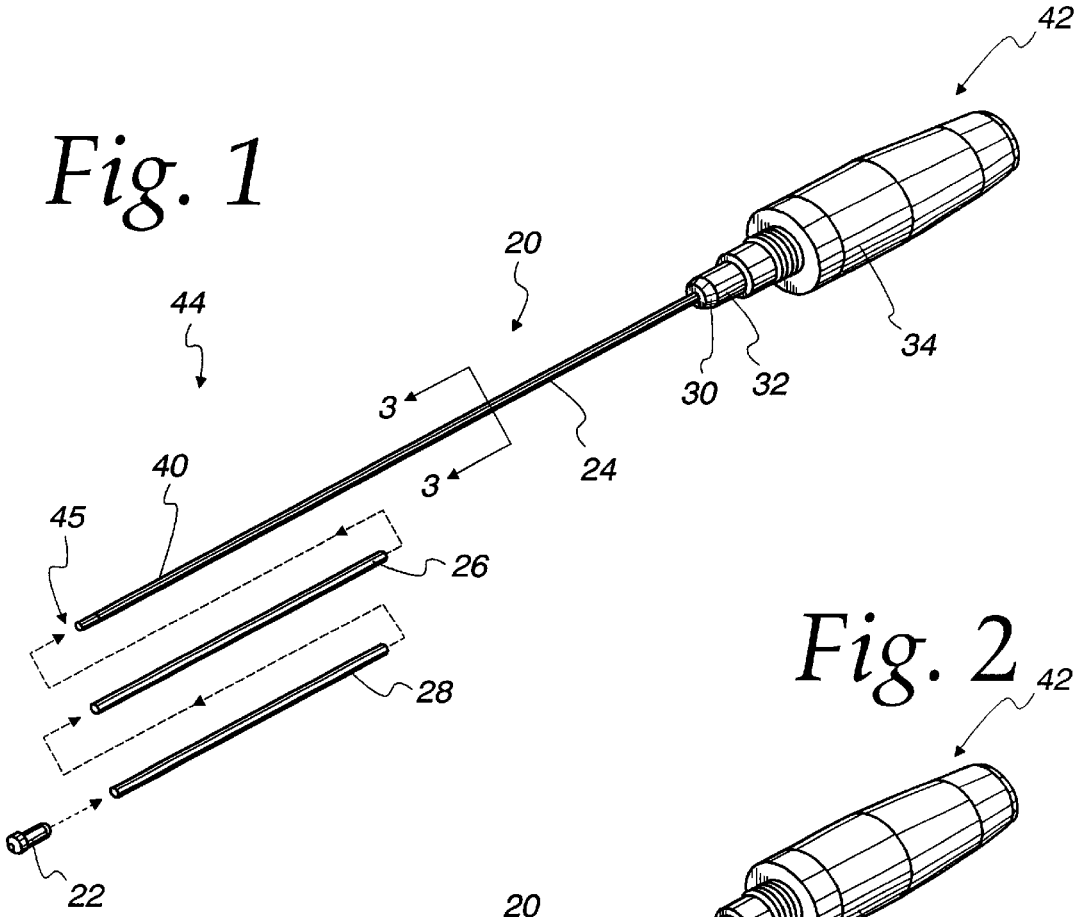
FIG. 1 is an exploded, perspective view of an antenna assembly according to the present invention.
Figure 2:
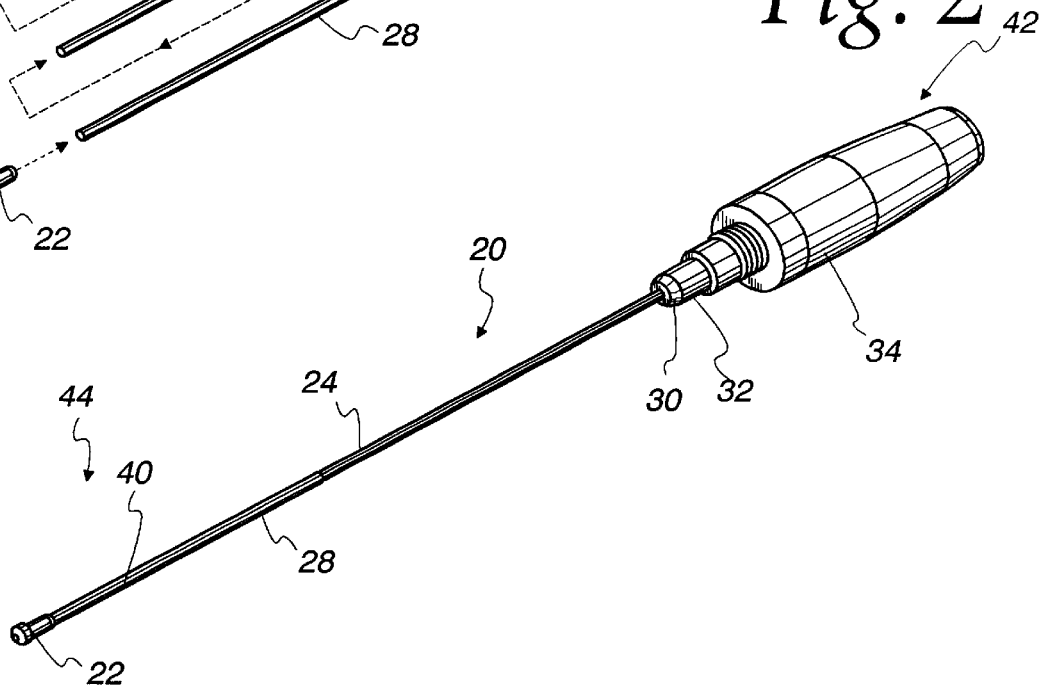
FIG. 2 is a perspective view of the antenna assembly in FIG. 1 in an assembled state.
Figure 3:
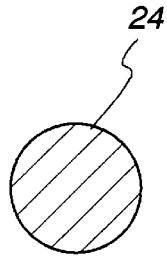
FIG. 3 is an enlarged, cross-sectional view of a shaft element taken at line 3—3 of FIG. 1.

The structure of an antenna assembly 20, according to the present invention, is discussed initially with respect to FIGS. 1–5, and in particular FIGS. 1 and 2. The antenna assembly 20 has a first contact 22, a shaft/first radiating element 24, a dielectric insert 26, a matching element 28, a dielectric sleeve 30, a second contact 32, and a second radiating element 34.

Figure 4:
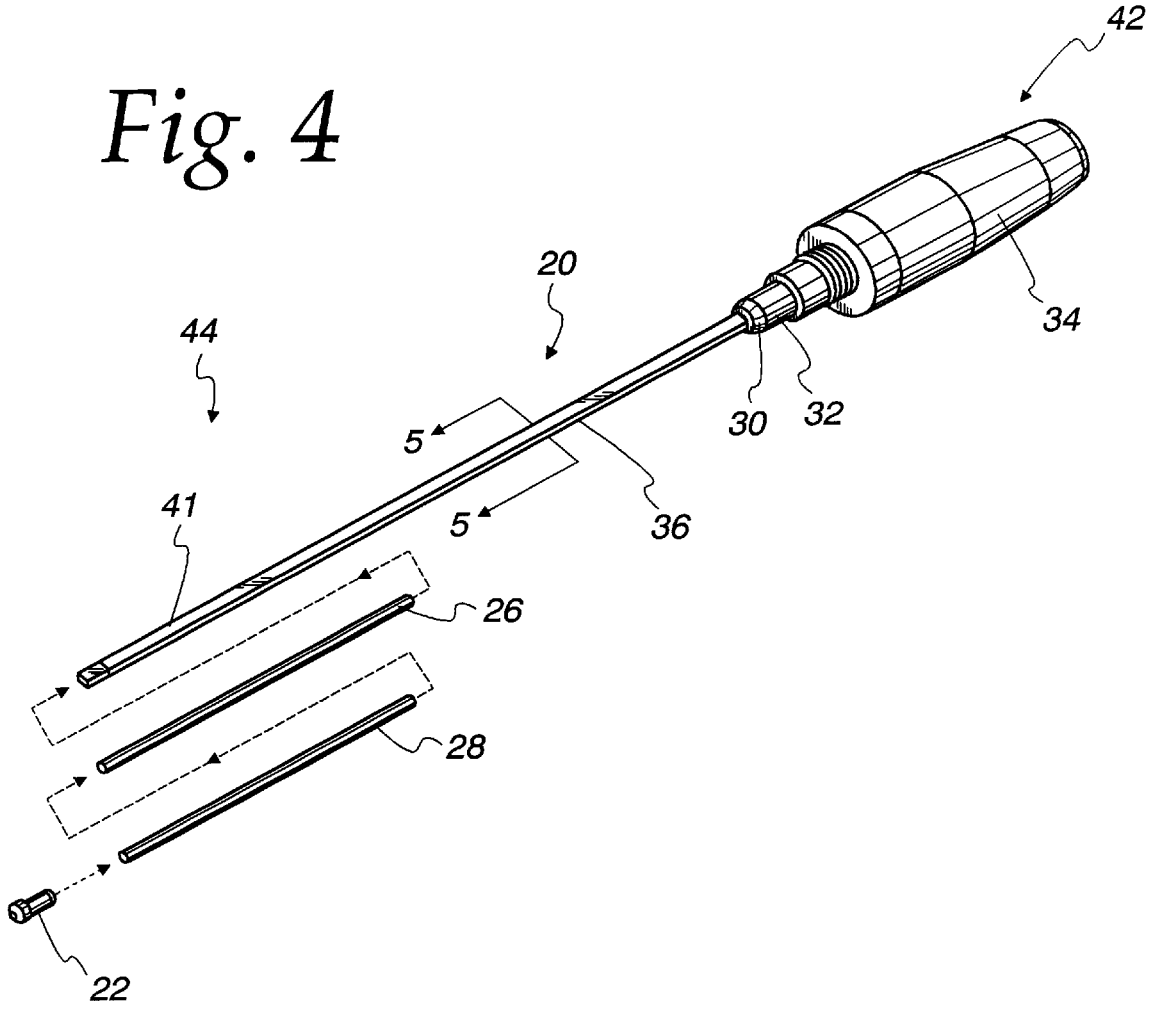
FIG. 4 is an exploded, perspective view of another antenna assembly according to the present invention.
Figure 5:
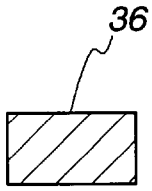
FIG. 5 is an enlarged, cross-sectional view of a shaft element taken at line 5—5 of FIG. 4.

The shaft/first radiating element 24 is a rod-like element made of a section of wire having preferably a circular cross-section (FIG. 3) having an outer diameter of 1–2 mm. Alternatively, a plate-like element 36 may be provided which has a rectangular cross-section, as shown in FIGS. 4 and 5. The portion of the shaft element 24, 36 between the second radiating element 34 and the matching element 28 is covered with an elastomeric-dielectric coating, preferably a polyurethane-silicon blend.

As shown in FIG. 1, the matching element 28 is a tube-like element having a preferably annular cross-section which is complementary to the circular cross-section of the shaft element 24. The matching element is complementary to the shaft element 24 so as to provide a space between the tube-like matching element 28 and the outer surface 40 of the shaft element 24 in which the dielectric insert 26 is disposed. If the shaft element 36 is used, the matching element 28 with an annular cross-section is still used, and an adhesive material is used to fill the additional space between the surface 41 of the shaft element 36, the dielectric insert 26 and the matching element 28.

The shaft element 24, 36 and the matching element 28 are made of a super-flexural alloy of nickel and titanium. Preferably, the nickel-titanium alloy is made up of approximately 50% by weight of nickel and 50% by weight of titanium. The dielectric insert 26 disposed therebetween is preferably polytetrafluoroethylene (PTFE) or polyetherimide (PEI).

The second radiating element 34 may be of any shape, but preferably includes a helix-like element made from a wire of circular cross-section, the helix having a diameter on the order of 10 mm. The second radiating element 34 is overmolded with a polymer material for mechanical protection.

As assembled in FIG. 2, the dielectric sleeve 30, the second contact 32, and the second radiating element 34 are disposed generally at a first effective end 42 of the shaft element 24 (i.e., the region proximate to a first end of the shaft element 24), to which the dielectric coating has previously been applied. First, the second radiating element 34 is joined to the shaft element 24, by crimping, for example. Preferably, the second radiating element 34 is pre-wound and overmolded when joined to the shaft element 24, although the second radiating element 34 could alternatively be joined to the shaft element 24, and then overmolded.

The second contact 32 and dielectric sleeve 30 are then slipped into place along the shaft element 24. The dielectric sleeve 30 and the second contact 32 are each joined to the shaft element 24 using conventional joining methods, such as adhesive bonding, for example.

The first contact 22, the dielectric insert 26, and the matching element 28 are then disposed generally at a second effective end 44 of the shaft element 24 (i.e., the region proximate to a second end 45 of the shaft element 24). Preferably, the dielectric insert 26 is applied to the shaft element 24 first, and then the matching element 28 slipped over the dielectric insert 26 and joined to the dielectric insert 26, by adhesive bonding, for example. The first contact 22 is then joined to the shaft element 24, by crimping, for example.

Figure 6:
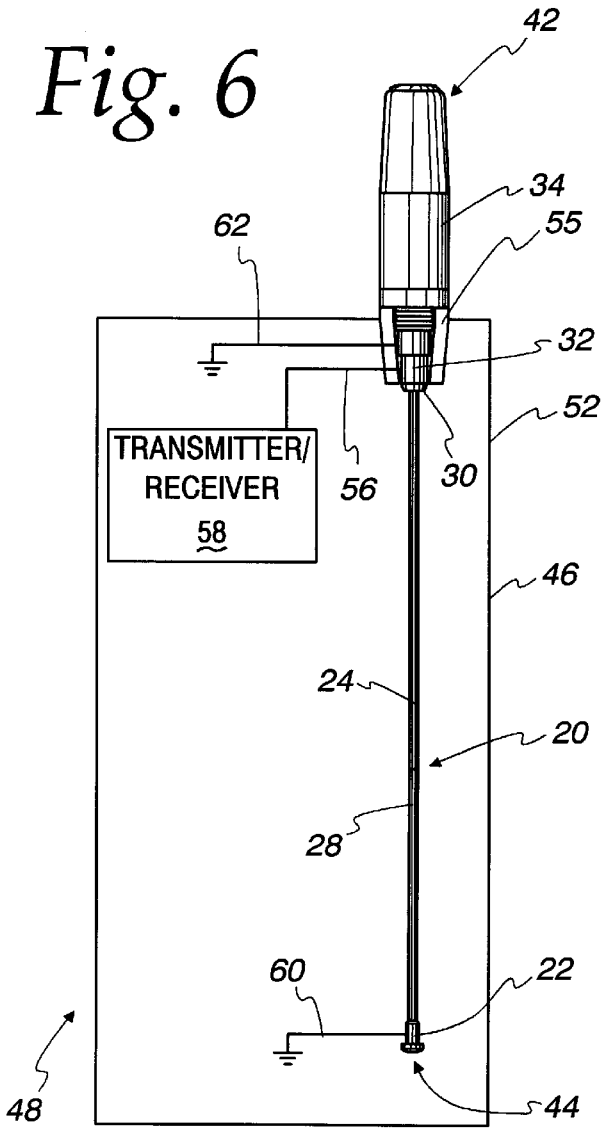
FIG. 6 is a schematic view of the antenna assembly of FIGS. 1 and 2 on a portable radio-communication device, such as a cellular phone, in a fully retracted position.
Figure 7:
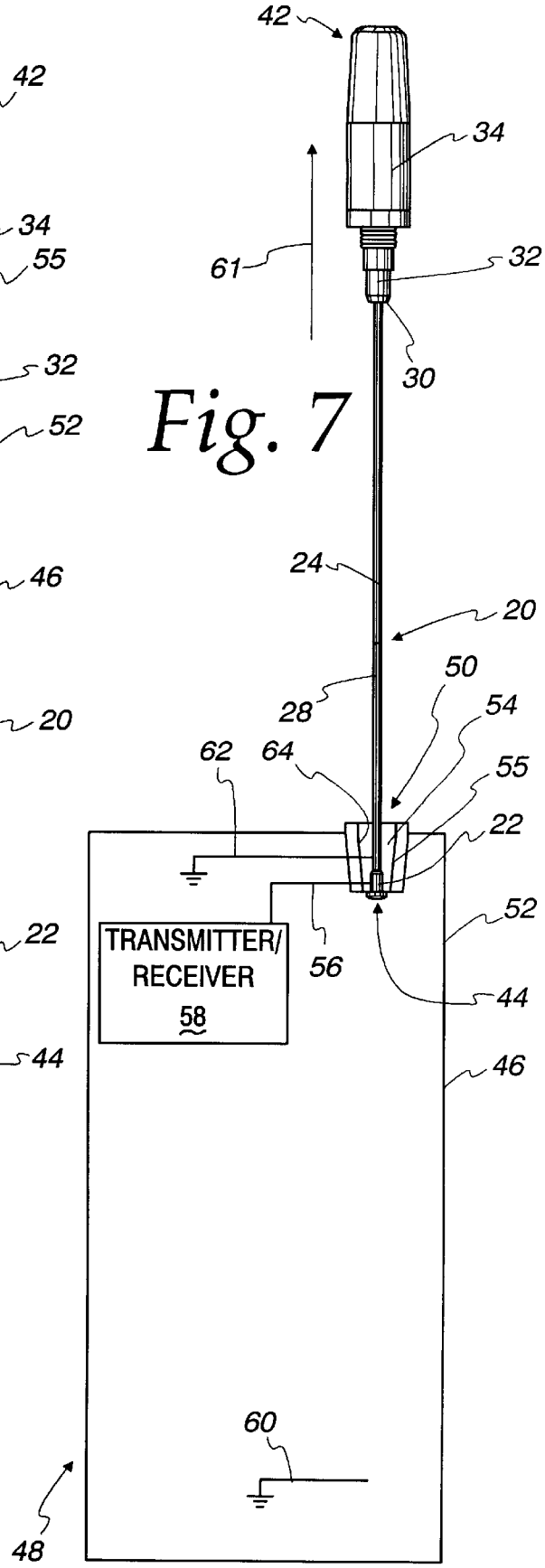
FIG. 7 is a view as in FIG. 6 with the antenna assembly in a fully extended position.

FIGS. 6 and 7 schematically illustrate the antenna assembly 20 as mounted in a housing 46 of a portable radio-communication device, such as a cellular phone 48. In both figures, the first effective end 42 of the shaft element 24 extends through an opening 50 in a wall 52 of the housing 46 of the device 48. In particular, a surface 54 of a plug 55 disposed on the wall 52 defines the opening 50.

FIG. 6 shows the antenna assembly 20 in a fully retracted position, projecting to a length on the order of 25–30 mm outside the housing 46. In the fully retracted position, the second radiating element 34 at the first effective end 42 of the shaft element 24 projects from the wall 52 of the housing 46. The second contact 32 is coupled to a feed 56 from a transmitter/receiver assembly 58. Optionally, the first contact 22 may be coupled to a ground 60. With the antenna assembly 20 in the fully retracted position, the second radiating element 34 preferably defines a quarter-wavelength radiator operating at, for example, the AMPS band (824–894 MHz). The second radiating element 34 preferably has an input impedance of 50 Ohms. By adding a parasitic element (such as is disclosed in U.S. patent application Ser. No. 08/929,592, the entire contents of which are hereby incorporated by reference herein) or forming the radiating element as a non-uniform pitch helix (such as is disclosed in U.S. patent application Ser. No. 08/725,507, the entire contents of which are hereby incorporated by reference herein), dual-band operation may be achieved, with the second radiating element 34 also defining a quarter-wavelength radiator operating at a higher frequency, for example at the PCS band (1850–1990 MHz) or the PDC band (1500 MHz).

From the fully retracted position of FIG. 6, the antenna assembly 20 may be moved to a fully extended position, as shown in FIG. 7, by exerting a force on the second radiating element 34 in the direction of the arrow 61. In the fully extended position, the second radiating element 34 and most of the shaft/first radiating element 24 project from the wall 52 of the housing 46 to a length on the order of 95 mm. The first contact 22 is coupled to the feed 56 from the transmitter/receiver assembly 58. The matching element 28 is coupled to a ground 62.

With the antenna assembly 20 in the fully extended position, the second radiating element 34 and the shaft/first radiating element 24 are exposed in series to preferably define a half-wavelength radiator operating at, for example, the AMPS band (824–894 MHz). The second radiating element 34 in series with the shaft/first radiating element 24 preferably has an input impedance of 50 Ohms.

Also, with the antenna assembly 20 in the fully extended position, the second radiating element 34, the shaft/first radiating element and the matching element 28 define a half-wavelength radiator operating at a higher frequency, for example at the PCS band (1850–1990 MHz) or the PDC band (1500 MHz). This half-wavelength radiator has an input impedance of 50 Ohms. In this fashion, dual-band operation is also achieved in the fully extended position.

Additionally, in the fully extended position, the matching element 28 is abuttable against the surface 54 of the plug 55. The matching element 28 thereby provides strength and rigidity to the shaft element 24 to prevent the shaft element 24 from bending about the fulcrum defined by an edge 64 of the surface 54 of the plug 55.

The antenna assembly 20 may have several advantages. By using the nickel-titanium alloy, the weight and size of the antenna assembly 20 may be reduced. Moreover, by providing a matching element 28 which strengthens and rigidities the shaft element 24, the bending of the antenna assembly 20 at the point of abutment with the housing 46 may be eliminated or limited without adding separate structural elements which would take up the room within the housing 46 without providing useful function in the operation of the radio-communication device 48.

Still other aspects, objects, and advantages of the present invention can be obtained from a study of the specification, the drawings, and the appended claims.

We claim:

1. An antenna assembly comprising:

a shaft element with first and second ends;

a tube-like matching element disposed about the shaft element which strengthens and rigidifies the antenna assembly to resist bending of a part of the shaft element; and a dielectric material disposed between the tube-like matching element and the shaft element.

2. The antenna assembly according to claim 1, wherein the shaft element defines a rod-like element.

3. The antenna assembly according to claim 2, wherein the shaft element defines a plate-like element.

4. The antenna assembly according to claim 1, wherein the shaft element defines a first radiating element.

5. The antenna assembly according to claim 4, further comprising a second radiating element coupled to the shaft element at the second end.

6. The antenna assembly of claim 5 wherein the first and second radiating elements are electrically coupled to define a radiator having a greater wavelength than the wavelength of either the first or second radiating elements operating alone.

7. The antenna assembly according to claim 1, wherein the shaft element and the tube-like matching element each comprise a nickel-titanium alloy.

8. The antenna assembly according to claim 1, wherein the shaft element and the tube-like matching element each comprise a nickel-titanium alloy where nickel and titanium are present in approximately equal percentages by weight.

9. The antenna assembly according to claim 1, wherein the dielectric material is selected from the group consisting of polytetrafluoroethylene and polyetherimide.

10. A portable radio-communication assembly comprising:

a housing with a surface having an edge;

an antenna assembly having a shaft element with first and second ends, a tube-like matching element disposed about the shaft element, and a dielectric material disposed between the tube-like matching element and the shaft element, the shaft element having a first retracted state and a second extended state in which the tube-like matching element is proximate to the edge, the tube-like matching element abuttable against the edge so as to resist bending of the shaft element proximate to the edge.

11. The radio-communication assembly according to claim 10, wherein the shaft element defines a first radiating element.

12. The radio-communication assembly according to claim 11, further comprising a second radiating element coupled to the shaft element at the second end, the second radiating element being disposed outside the housing with the shaft element in the first and second states.

13. The radio-communication assembly according to claim 12, wherein the antenna assembly defines a quarter-wavelength radiator with the shaft element in the first state, and defines a half-wavelength radiator with the shaft element in the second state.

14. The radio-communication assembly according to claim 12 wherein the first and second radiating elements are electrically coupled to define a radiator having a greater wavelength in the second state than in the first state.

15. The radio-communication assembly according to claim 10, wherein the shaft element and the tube-like matching element each comprise a nickel-titanium alloy.

16. The radio-communication assembly according to claim 10, wherein the shaft element and the tube-like matching element each comprise a nickel-titanium alloy where nickel and titanium are present in approximately equal percentages by weight.

17. The radio-communication assembly according to claim 10, wherein the dielectric material is selected from the group consisting of polytetrafluoroethylene and polyetherimide.

18. A method of reconfiguring an antenna assembly on a radio-communication assembly having a housing with a surface, said method comprising the steps of:

providing an antenna assembly on the housing with a shaft element moveable between first and second positions relative to the surface of the housing;

providing a tube-like matching element disposed about the shaft element such that the matching element mechanically reinforces a part of the shaft element;

moving the shaft element from the first position to the second position; and abutting the tube-like matching element against the surface of the housing as an incident of the shaft element being moved from the first position into the second position so that the tube-like matching element resists deformation of the shaft element adjacent the surface of the housing;

coupling the tube-like matching element to ground with the shaft element moved into the second position.

19. The method according to claim 18, wherein the surface of the housing has an edge, and the step of abutting the tube-like matching element against the surface of the housing comprises the step of abutting the tube-like matching element against the edge of the surface of the housing as an incident of the shaft element being moved from the first position into the second position so that the tube-like matching element resists deformation of the shaft element about a fulcrum defined by the edge of the surface of the housing.

20. The method according to claim 18, wherein the surface of the housing defines an edge which further defines an opening in the housing, the step of moving the shaft element from the first position to the second position comprises moving the shaft element through the opening from the first position to the second position, and the step of abutting the tube-like matching element against the surface of the housing comprises the step of abutting the tube-like matching element against the edge of the surface of the housing as an incident of the shaft element being moved through the opening from the first position to the second position so that the tube-like matching element resists deformation of the shaft element about a fulcrum defined by the edge rim of the surface of the housing.

21. The method according to claim 18, wherein the shaft element and the tube-like matching element each comprise a nickel-titanium alloy.

22. The radio-communication assembly according to claim 18, wherein the shaft element and the tube-like matching element each comprise a nickel-titanium alloy where nickel and titanium are present in approximately equal percentages by weight.

23. The method according to claim 18, wherein the antenna assembly defines a quarter-wavelength radiator with the shaft element in the first position, and, as an incident of the shaft element being moved from the first position into the second position, defines a half-wavelength radiator.

24. An antenna assembly comprising:

a shaft element with first and second ends;

a contact disposed at the first end of the shaft element and electrically coupled to the shaft element;

a tube-like matching element disposed about the shaft element, the tube-like matching element strengthening and rigidifing the antenna assembly to resist bending of at least a part of the shaft element; and a dielectric material disposed between the tube-like matching element and the shaft element.

25. The antenna assembly according to claim 24, wherein:

the shaft element has an outer surface;

the tube-like matching element has an inner surface facing the outer surface of the shaft element, the inner surface of the tube-like matching element and the outer surface of the shaft element defining a space therebetween; and the dielectric material is disposed between the tube-like matching element and the shaft element in the space.

26. The antenna assembly according to claim 24, wherein:

the shaft element has a longitudinal axis;

the tube-like matching element has a longitudinal axis;

the longitudinal axis of the tube-like matching element is substantially aligned with the longitudinal axis of the shaft element so that the tube-like element is substantially concentric with the shaft element, defining therebetween an annularly-shaped space; and the dielectric material is disposed between the tube-like matching element and the shaft element in the annularly-shaped space.

* * * * *